US010392848B2

(12) United States Patent
Bortoluzzi et al.

(10) Patent No.: US 10,392,848 B2
(45) Date of Patent: Aug. 27, 2019

(54) DAMPING OR RETURN DEVICE FOR SLIDING DOOR LEAVES

(71) Applicant: BORTOLUZZI SISTEMI S.P.A., Belluno (IT)

(72) Inventors: Guido Bortoluzzi, Belluno (IT); Adriano Girotto, Spresiano (IT); Lucio Moliner, Santa Giustina (IT)

(73) Assignee: BORTOLUZZI SISTEMI S.P.A., Belluno (IT)

( * ) Notice: Subject to any disclaimer, the term of this patent is extended or adjusted under 35 U.S.C. 154(b) by 57 days.

(21) Appl. No.: 15/525,677

(22) PCT Filed: Nov. 6, 2015

(86) PCT No.: PCT/EP2015/075973
§ 371 (c)(1),
(2) Date: May 10, 2017

(87) PCT Pub. No.: WO2016/075050
PCT Pub. Date: May 19, 2016

(65) Prior Publication Data

US 2017/0321464 A1 Nov. 9, 2017

(30) Foreign Application Priority Data

Nov. 11, 2014 (IT) ..... MI20140344 U

(51) Int. Cl.
*E05F 5/00* (2017.01)
*E05F 5/02* (2006.01)

(52) U.S. Cl.
CPC ..... *E05F 5/003* (2013.01); *E05F 5/02* (2013.01); *E05F 5/027* (2013.01); *E05Y 2201/46* (2013.01); *E05Y 2900/20* (2013.01)

(58) Field of Classification Search
CPC ... E05F 5/003; E05F 5/027; E05F 5/02; E05F 3/00; E05D 13/10; E05D 15/0643; E05D 15/0652; E05D 2015/0695; E05Y 2900/20; E05Y 2201/40; E05Y 2201/46; A47B 96/00
USPC ..... 188/267; 267/170, 182, 293; 16/82, 83, 16/85, 86 R
See application file for complete search history.

(56) References Cited

U.S. PATENT DOCUMENTS 5,010,622 A 4/1991 Morita
9,752,367 B2 * 9/2017 Girotto ..... E05D 15/0652
(Continued)

FOREIGN PATENT DOCUMENTS

DE 195822254 A1 1/1997
DE 202010003575 A1 7/2010
EP 2330269 A2 6/2011
(Continued)

OTHER PUBLICATIONS

Written Opinion and Search Report or International Application No. PCT/EP2015/075973; dated Jan. 29, 2016; 10 pages.
(Continued)

*Primary Examiner* — Pamela Rodriguez
(74) *Attorney, Agent, or Firm* — Brooks Kushman P.C.

(57) ABSTRACT

A damping or return device for sliding door leaves, particularly for furniture, which is constituted by a steel pin that slideably and axially interacts within a magnet constituted by a diametrically differently-polarized collar.

20 Claims, 4 Drawing Sheets

(56) References Cited

U.S. PATENT DOCUMENTS

| | | | | |
|---|---|---|---|---|
| 2011/0167588 | A1* | 7/2011 | Chang | E05F 5/003<br>16/71 |
| 2013/0056306 | A1* | 3/2013 | Lee | B66B 13/24<br>187/314 |

FOREIGN PATENT DOCUMENTS

| | | | |
|---|---|---|---|
| EP | 2455571 | A1 | 5/2012 |
| EP | 2557259 | A2 | 2/2013 |
| WO | 2014180729 | A1 | 11/2014 |
| WO | 2016075051 | A1 | 5/2016 |
| WO | 2016083217 | A1 | 6/2016 |

OTHER PUBLICATIONS

International Preliminary Report on Patentability for International Application No. PCT/EP2015/075973; dated Oct. 16, 2016; 6 pages.

* cited by examiner

DAMPING OR RETURN DEVICE FOR SLIDING DOOR LEAVES

CROSS-REFERENCE TO RELATED APPLICATIONS

This application is the U.S. national phase of PCT Application No. PCT/EP2015/075973 filed on Nov. 6, 2015, which claims priority to Italian Patent Application No. MI2014U000344 filed on Nov. 11, 2014, the disclosures of which are incorporated in their entirety by reference herein.

TECHNICAL FIELD

The present invention relates to a damping or return device for sliding door leaves, of the type with co-planar closure or otherwise, particularly for furniture and the like.

BACKGROUND

Nowadays as an alternative to usual, hinged doors, solutions are known for sliding doors that can be applied both to wardrobes and pieces of furniture in general, and also to door and window frames or to any other application of closing elements that require a reduced space when open.

Usually such types of door are constituted by one or more door leaves, each one of which has brackets with rolling means that are guided by a rail, which is constituted by an upper guide and by a lower guide, which respectively are applied to the ceiling and optionally to the floor of the compartment to be closed.

It is known to fit the door leaf with a device to return it to the open position, which can be disengaged as needed when it is desired to close the sliding door, or to the closed position, when it is desired that the door leaf follow a guided closure.

A problem that is found in conventional sliding door leaves is constituted by the fact that the door leaf can remain partially closed or partially open or it can slam, on the jambs of the door or on the sides of the item of furniture, when the door leaf is completely opened or completely closed.

A partial solution to such drawback is known from EP1658785 which discloses to a device that is adapted to assist and guide the movement of a door leaf, which comprises a receptacle inside which is placed a damper, a spring, and an entrainment element that can be accommodated within a pair of teeth that are associated with a coupling element which comprises a guiding pin that can slide into an upturned L-shaped guide.

The device is arranged proximate to one end of the compartment.

For example, when opening the door leaf, at a certain point the device hooks the entrainment element that activates the damper until the pin is positioned, through the L-shaped guide, in a stable and stationary condition: when the door leaf is closed, the entrainment element interacts with the pair of teeth and activates the damper which thus gently accompanies the door up until the condition where it is completely closed.

Such solution however suffers some drawbacks: the device is in fact complex in terms of construction in that it is constituted by a plurality of elements that have to be put together in advance while paying great attention to the elements of play that exist for example between the L-shaped guide and the pin that rests in it, since any sticking or the creation of friction could defeat the operation of the device and thus prevent the correct closing or complete opening of the door leaf.

Furthermore, conventional return devices suffer other criticalities which are linked to the fact that the return spring does not have a constant force along its stroke.

This causes problems with the return along the final part of the stroke because the force is low and there are, inversely, problems with opening the door in the final part when the door is released, where the force of the spring is too high.

This, combined with the fact that the connection to the return mechanism of the door in motion occurs by way of mechanical means, creates bothersome noise in operation.

EP 2455571 is also known, and discloses a mechanism for forcible movement which comprises a first urging body to apply a force toward a certain position for a fixed body in a standby position.

A striker body is captured at a prescribed position by the fixed body which is held in standby position, and a movable body is moved up to a position at end of movement by way of the relative movement of the fixed body to the determined position by the release of the hold on the occasion of the capture.

A damping mechanism comprises a contact part for connection with the fixed body constituting the mechanism for forcible movement, a second body urging the contact part in an advancement direction.

The damping mechanism is constituted so as to apply a resistance to a retraction of the contact part accompanying the movement of the fixed body to the determined position.

Such solution also suffers the same drawbacks mentioned previously.

EP 2557259 is also known, which discloses a braking device that comprises pneumatic braking means which can be activated by way of a slider interacting with a fixed frame, for example of the door; in one embodiment there is a piston the rod of which is provided, at the end tip, with a magnetic head the function of which is, once it has come into contact with a fixed L-shaped profile with one wing positioned head-on to the magnetic head, to allow the rod to be extracted from the stem of the piston.

Such solution suffers many drawbacks such as the considerable length required for the braking device, the stem of which is subject to possible breakage or sticking; furthermore, the reliability of the pneumatic functionality is poor.

Finally the sole function of the magnetic head is to directly couple to a fixed body, arranged along the same axis, for the extraction of the stem.

EP 2330269 is also known, which discloses a sliding guide for doors of wardrobes which has a damper stop comprising a trolley consisting of a first frame and a second frame shaped like an upturned "U" to which the upper ends of an outer or inner door are fixed.

The damper stop comprises an air or gas damper fixed outside two seats which are provided on a section associated with the trolley.

Such solution also suffers many drawbacks, such as the use of a gas damper which, moreover, is arranged laterally to the trolley so as to increase the space taken up and render the guide barely usable.

SUMMARY

The aim of the present invention is therefore to resolve the above mentioned technical problems, by eliminating the drawbacks in the cited known art and hence providing a device, which can be applied to sliding doors or door leaves, which has a simple structure, which is free from sticking and which makes it possible to obtain the optimal closing and guided opening of the door or of the door leaf while preventing the same from slamming against the wall of the item of furniture.

Within this aim, another object of the invention is to provide a device that is easily applied to conventional door leaves or to conventional doors of furniture.

Another object is to provide a device the dimensions and weight of which are contained and which therefore is low cost.

Another object of the invention is to provide a device by which it is possible to contain the friction and elements of play in the various movements, thereby optimizing the movement and the sliding of the door leaf.

Another object is to provide a device that is free from bothersome noises during its operation.

This aim and these and other objects which will become better apparent hereinafter are achieved by a damping or return device for sliding door leaves of furniture, which is characterized in that it is constituted by a steel pin which slideably and axially interacts within a magnet constituted by a diametrically differently-polarized collar.

BRIEF DESCRIPTION OF THE DRAWINGS

Further characteristics and advantages of the invention will become better apparent from the detailed description of a particular, but not exclusive, embodiment, which is illustrated by way of non-limiting example in the accompanying drawings wherein.

DETAILED DESCRIPTION

Figure 1:
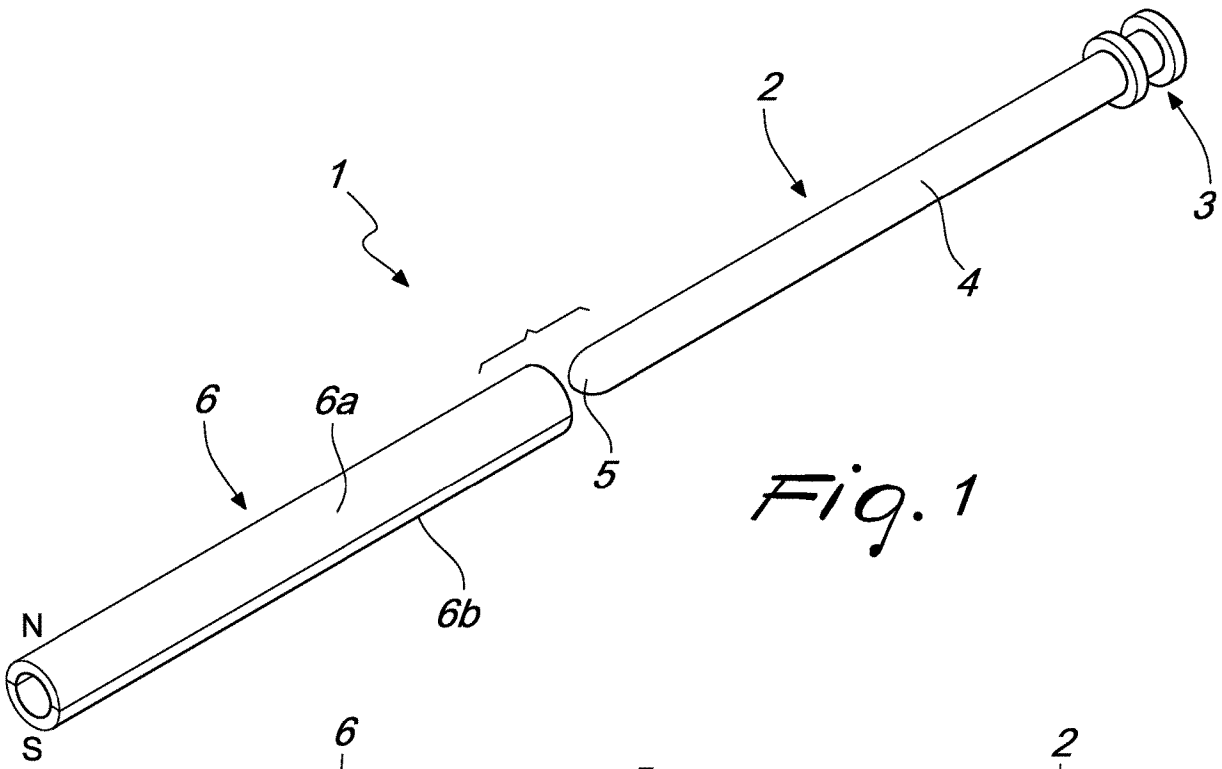
FIG. 1 is a perspective exploded view of a device according to the invention.
Figure 2:
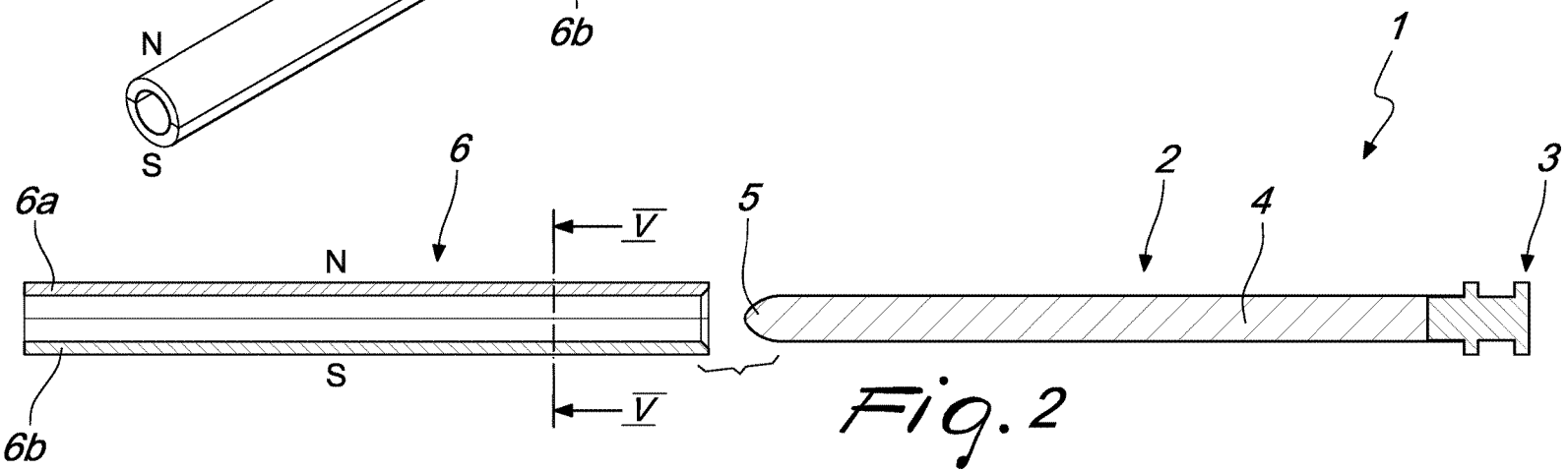
FIG. 2 is a cross-sectional view of the device of FIG. 1.
Figure 5:
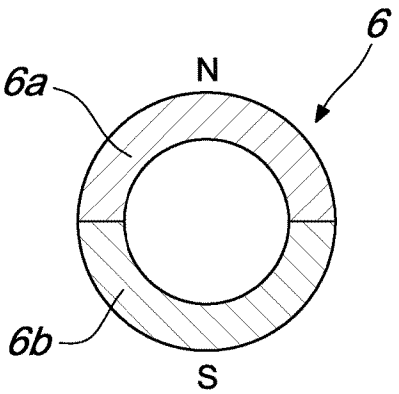
FIG. 5 is a cross-sectional view taken along the line V-V in FIG. 2.
Figure 3:
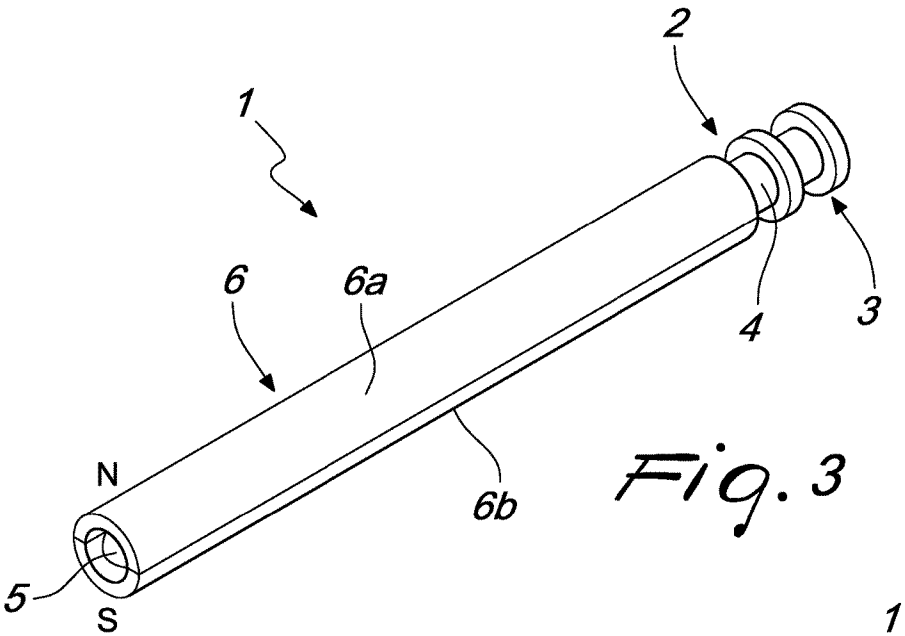
FIG. 3 is a view similar to FIG. 1 with the device coupled to the diametrically differently-polarized collar.
Figure 4:
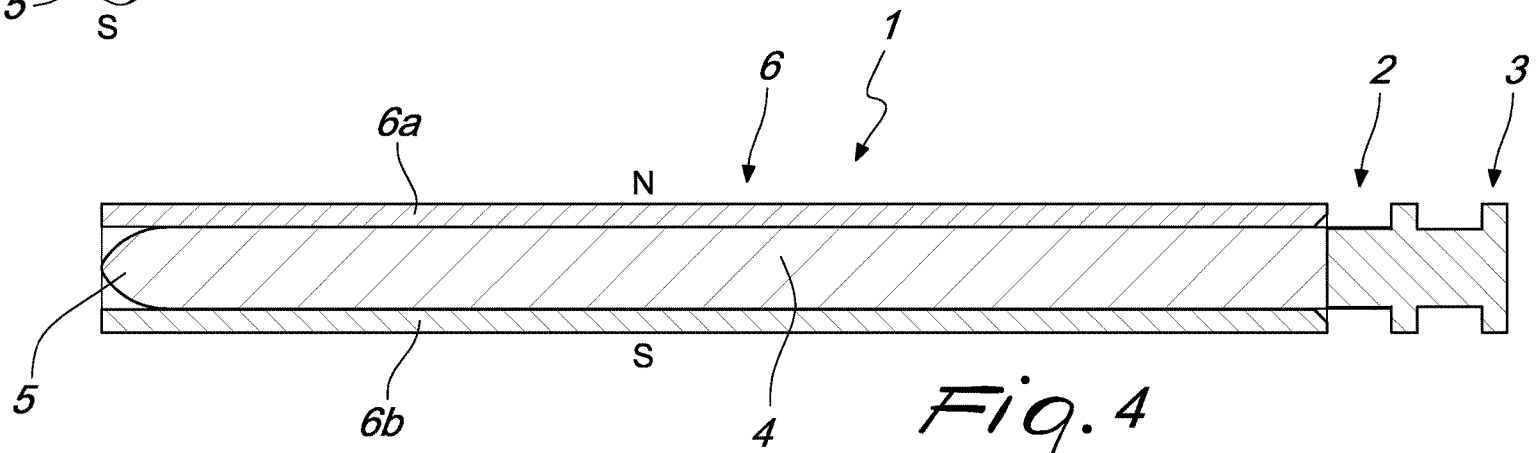
FIG. 4 is a view similar to FIG. 2 showing the device coupled to the diametrically differently-polarized collar.

In the embodiments illustrated, individual characteristics shown in relation to specific examples may in reality be interchanged with other, different characteristics, existing in other embodiments.

With reference to the figures, the reference numeral 1 generally designates a device that is associated with a slideable door leaf, particularly for furniture and the like (not shown).

The device 1 is constituted by a pin 2, made of steel, with a first head 3 which is polygonal, preferably circular, in plan view with a H-shaped transverse cross-section, from which a polygonal, preferably circular, shank 4 protrudes axially, the end tip 5 of which is substantially V-shaped or rounded.

The device 1 is further made up of a magnet 6 which is constituted by a collar and is shaped complementarily to the shank 4 of the pin 2 and therefore is, in the particular embodiment, circular in plan view.

The collar that constitutes the magnet 6 has its two ends open, or one of the two is closed.

The shank 4 of the pin 2 can be slideably and axially arranged inside the magnet 6.

The magnet 6 is diametrically polarized differently: it is therefore, from the magnetic point of view, divided into a first half-collar 6*a* and a second half-collar 6*b*, which are coupled together and are mutually identical, are semicircular and have opposing polarities.

For example the first half-collar 6*a* has a north polarity N and the second half-collar 6*b* has a south polarity S.

The magnet 6 is structured so that upon the insertion into it of the shank 4 of the pin 2 the latter is slideable without sliding friction.

The shank 4 of the steel pin 2 moves in contrast with a damping element 7 which is constituted for example by a spring arranged inside the diametrically differently-polarized magnet 6.

Figure 6:
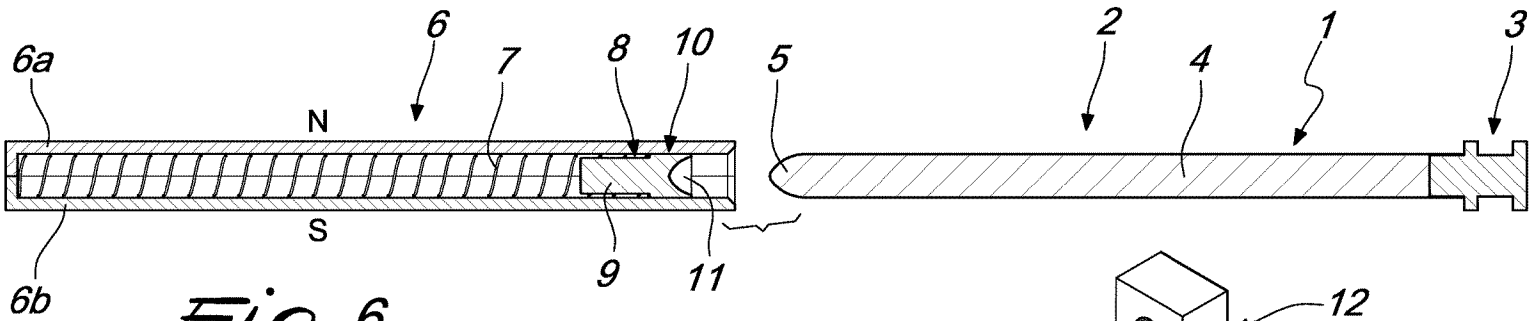
FIG. 6 is a view of a device which is similar to the view in FIG. 2 in which there is a damping element arranged in the diametrically differently-polarized collar.

In the embodiment shown in FIG. 6 the damping element 7 is arranged inside the diametrically differently-polarized magnet 6; advantageously the length of the damping element 7 is shorter than that of the diametrically differently-polarized magnet 6.

At the end 8 of the damping element 7 directed toward the end tip 5 of the pin 2, the complementarily-shaped shank 9 of an insert 10 which can slide within the magnet 6 is axially inserted.

The insert 10 advantageously has a second head 11 which is complementarily shaped to the end tip 5 of the pin 2 in order to facilitate the mutual coupling.

Figure 7:
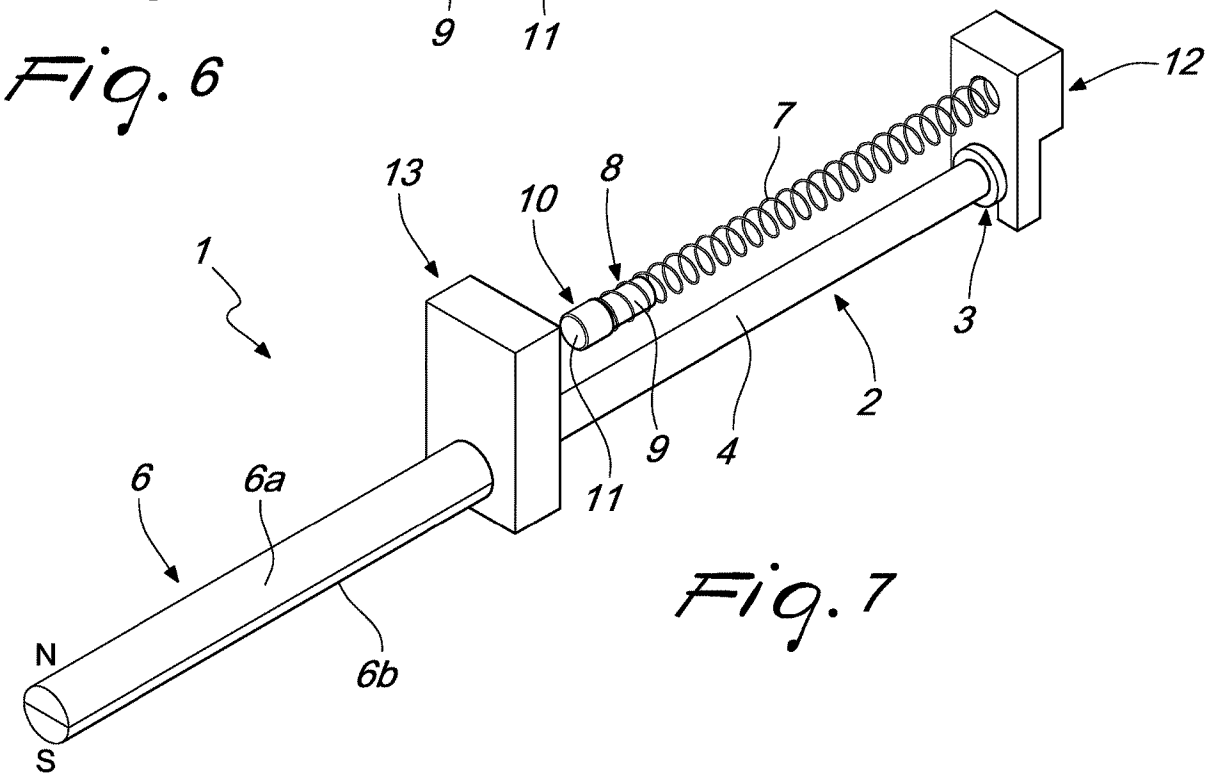
FIG. 7 is a view of the device which is similar to the view in FIG. 1 in which there is a damping element.
Figures 8, 9:
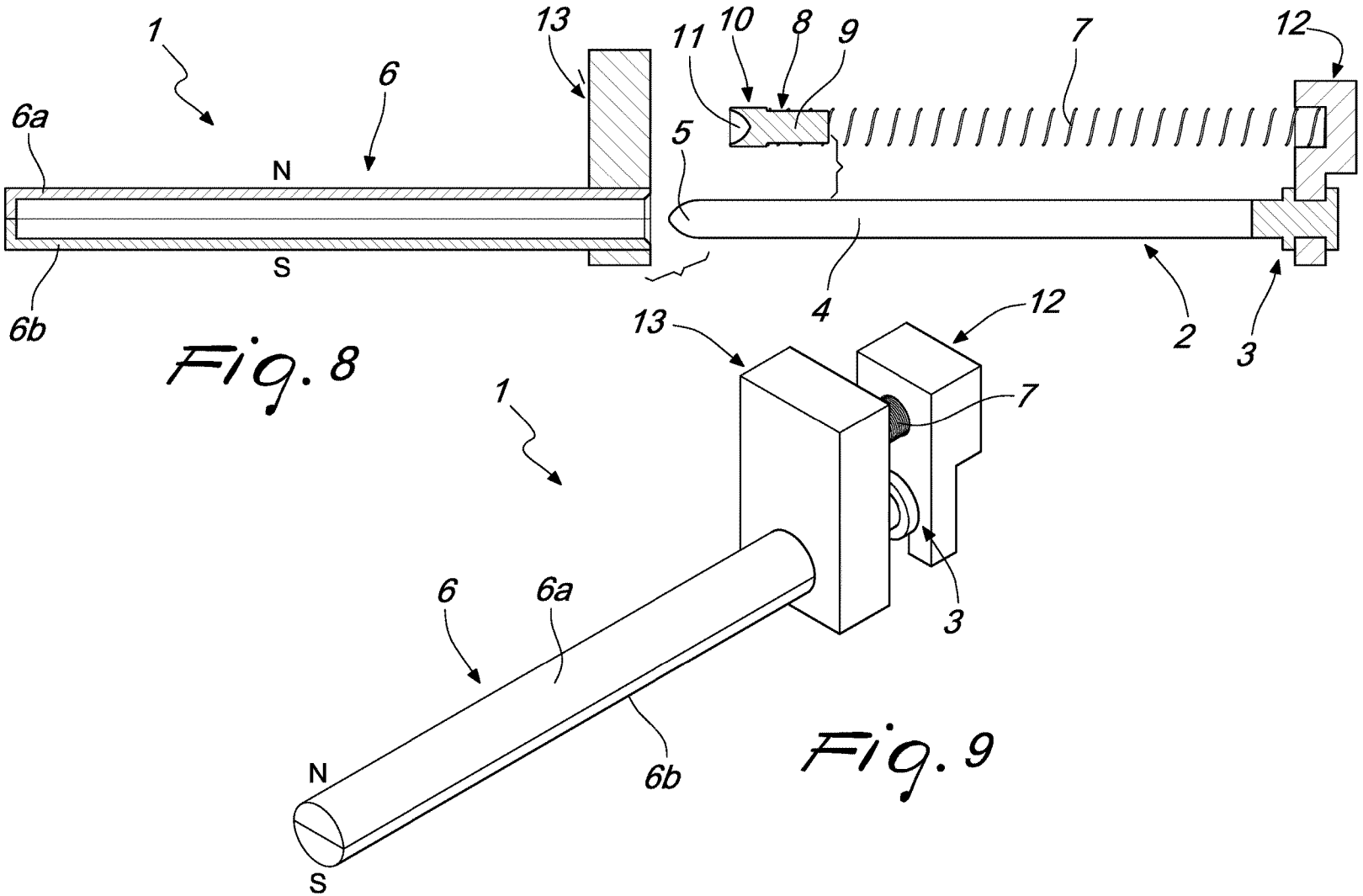
FIG. 8 is a view of the device in FIG. 7, similar to the view in FIG. 2.
FIG. 9 is a view of the device showing the pin coupled, in the end-of-stroke condition, to the diametrically differently-polarized collar.

FIGS. 7 to 9 show a solution in which the damping element 7 is associated with and protrudes at right angles from a first appendage 12 which is in turn associated with and protrudes radially from the first head 3.

The damping element 7 is arranged substantially parallel to the shank 4 in the direction of the free end 5 of the shank 4.

The free end 8 of the damping element 7 interacts in abutment with a second appendage 13 which protrudes radially from one of the first or second half-collars 6*a*, 6*b* which make up the magnet 6; in the embodiment shown, the second appendage 13 protrudes from the second half-collar 6*a*.

Operation of the device is as follows: after having obtained the diametrically differently-polarized magnet 6, in the final stage of closing a door leaf, with which the pin 2 is associated, the shank 4 penetrates inside the magnet 6 and is kept in axial alignment by it without there being sliding friction.

The end tip 5 of the shank 4 then interacts with the damping element 7, if present, which slows the stroke thereof until it is stopped at the desired point when it reaches its stroke limit, optimally and continuously, and exerting a force that is constant both during closing and during opening.

The presence of the insert 10 makes it possible to improve the sliding of the spring inside the collar and improve the compression and elongation phase of that spring.

In practice it has been found that the invention has fully achieved the intended aim and objects, a device being obtained that can be applied to sliding doors or door leaves, including existing doors or door leaves, and is provided with a simple structure that, partly thanks to the use of the diametrically differently-polarized collar, is free from the presence of sliding friction between components and from sticking, thus making it possible to achieve the optimal guided closing and opening of the door or of the door leaf while preventing the same from slamming on the wall of the item of furniture.

Furthermore, the weight and dimensions and cost of the device are contained, while at the same time making it possible to contain the friction and elements of play in the various movements, so as to optimize the movement and the sliding of the door leaf.

Obviously, the materials used as well as the dimensions of the individual components of the invention may be more relevant according to specific requirements.

The various means of achieving certain different functions certainly need not coexist only in the embodiment shown, but may be present in many embodiments, even if they are not shown.

The characteristics indicated above as advantageous, convenient or the like, may also be missing or be substituted by equivalent characteristics.

The disclosures in Italian Utility Model Application No. MI2014U000344 (202014902308351) from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

The invention claimed is:

1. A damping or return device for sliding door leaves of furniture, the device comprising:

a steel pin which is associated with a door leaf of furniture and slideably and axially interacts within a magnet constituted by a diametrically differently-polarized collar comprising mutually coupled first and second portions having opposing polarities.

2. The device according to claim 1, wherein the steel pin has a first head which is polygonal in plan view from which a shank protrudes axially, an end tip of which is substantially V-shaped or rounded.

3. The device according to claim 2, wherein the shank of the steel pin moves in contrast with a damping element.

4. The device according to claim 3, wherein the damping element comprises at least one spring arranged within the magnet.

5. The device according to claim 3, wherein the damping element comprises at least one spring which is arranged outside the magnet.

6. The device according to claim 2, wherein the shank of the pin can be slideably and axially arranged inside the magnet without sliding friction.

7. The device according to claim 2, wherein the magnet is divided into a first half-collar and a second half-collar, which are coupled together and are mutually identical and have opposing polarities.

8. The device according to claim 7, wherein the first half-collar has a north polarity and the second half-collar has a south polarity.

9. The device according to claim 7, wherein the length of the damping element is shorter than that of the magnet, at an end of the damping element directed toward the end tip of the pin having an insert which can slide axially within the magnet, the insert having a second head which is shaped complementarily to the end tip of the pin.

10. The device according to claim 9, wherein the damping element is associated with and protrudes at right angles from a first appendage which is in turn associated with and protrudes radially from the first head, the damping element being arranged substantially parallel to the shank of the pin in the direction of the end tip of the shank, the end of the damping element interacting in abutment with a second appendage which protrudes radially from one of the first or second half-collars which make up the magnet.

11. The device according to claim 1, wherein the collar is shaped complementarily to the pin, the collar having two ends open or one of the two is closed.

12. A damping or return device for sliding door leaves of furniture, the device comprising:

a magnetic collar having first and second portions with opposing polarities arranged diametrically opposite of each other, the magnetic collar associated with a first sliding door leaf; and a steel pin associated with a second sliding door leaf, wherein the pin is adapted to slide axially within the magnetic collar and the pin is thereby retained within the magnetic collar to retain the first and second door leaves in a closed position.

13. The device according to claim 12, wherein the magnetic collar has an opening to receive the pin, the opening shaped complementarily to a shank of the pin.

14. The device according to claim 13, wherein the shank of the pin slides axially within the opening of the magnetic collar without sliding friction.

15. The device according to claim 12, further comprising the damping element associated with one of the first sliding door leaf or second sliding door leaf, wherein the pin moves in contrast with a damping element when damping movement of the first door leaf relative to the second door leaf.

16. The device according to claim 15, wherein the damping element comprises a spring arranged inside the magnet.

17. The device according to claim 15, wherein the damping element comprises a spring, wherein a length of the spring is shorter than a length of the magnetic collar.

18. The device according to claim 15, wherein the damping element is associated with and protrudes at a right angle from a first appendage which is associated with and protrudes radially from the pin, the damping element being arranged substantially parallel to a length of the pin, an end of the damping element abutting a second appendage which protrudes radially from the magnetic collar.

19. The device according to claim 15, wherein the damping element comprises a spring arranged outside the magnetic collar.

20. A damping or return device for sliding door leaves of furniture, the device comprising:

a magnetic collar having a first half-collar and a second half-collar with opposing polarities coupled together, the magnetic collar associated with a first sliding door leaf; and a steel pin associated with a second sliding door leaf, wherein the pin is adapted to slide axially within the magnetic collar and the pin is thereby retained within the magnetic collar to retain the first and second door leaves in a closed position.

* * * * *